US005900544A

United States Patent [19]

Weng et al.

[11] Patent Number: 5,900,544

[45] Date of Patent: May 4, 1999

[54] SYSTEM AND METHOD FOR DETECTING UPWARD GROWTH OF A HYDRAULIC SUBTERRANEAN FRACTURE IN REAL TIME

[75] Inventors: Xiaowei Weng; Kirk M. Bartko, both of Plano, Tex.

[73] Assignee: Atlantic Richfield Company, Los Angeles, Calif.

[21] Appl. No.: 08/907,835

[22] Filed: Aug. 14, 1997

[51] Int. Cl.[6] ..... E21B 49/00

[52] U.S. Cl. ..... 73/152.27

[58] Field of Search ..... 73/152.41, 152.39, 73/152.51; 166/250.1

[56] References Cited

U.S. PATENT DOCUMENTS 3,604,256 9/1971 Pratts ..... 73/152.41

OTHER PUBLICATIONS

SPE/DOE/GRI 12852; "Fracture Diagnostics Results for the Multiwell Experiment's Paludal Zone Stimulation" by C.M. Hart, D. Engl, R.P. Fleming, and H.E. Morris, Sandia National Laboratories.

*Primary Examiner*—William Oen
*Assistant Examiner*—Jewel V. Thompson
*Attorney, Agent, or Firm*—F. Lindsey Scott; Jack D. Stone

[57] ABSTRACT

A method for detecting in real time the growth of a hydraulic fracture in an impermeable subterranean zone separating a monitored subterranean zone and an injection subterranean zone, which zones are penetrated by a wellbore, whereby a pressure sensor is positioned in pressure sensing communication with the first subterranean zone, and the pressure sensor is monitored for a pressure increase in the first subterranean zone, the pressure increase being indicative of a hydraulic fracture extension from the second subterranean zone through the impermeable zone to the first subterranean zone.

11 Claims, 2 Drawing Sheets

SYSTEM AND METHOD FOR DETECTING UPWARD GROWTH OF A HYDRAULIC SUBTERRANEAN FRACTURE IN REAL TIME

FIELD OF THE INVENTION

The invention relates generally to detecting, in real time, the upward growth of hydraulic fractures in subterranean formations.

BACKGROUND OF THE INVENTION

Subterranean, geologic formations may include permeable strata or layers, such as sand, which are generally bounded on at least one side by an impermeable strata, such as shale. The permeable strata have the capacity for holding liquid and gaseous fluids which may flow through the strata within the bounds of the impermeable strata. In relatively shallow formations, permeable strata may comprise aquifers and sources of useful water. In relatively deep formations, permeable strata may comprise reservoirs of brine or hydrocarbons such as oil and natural gas.

A permeable subterranean formation bounded both above and below by impermeable strata may have the capacity to receive and hold fluids or slurries and, as such, be attractive as a repository for the permanent storage of hazardous waste materials, such as radioactive liquids or slurries, waste solids or sludges, or other toxic or undesirable liquids or gasses.

To remove hydrocarbons from, or to inject waste materials into, the subterranean formations, wells, such as oil wells, are formed which extend from a well head at the ground surface to the subterranean formations.

Whether fluids or slurries are removed from or injected into a permeable subterranean formation, it is often desirable to fracture the permeable formation to enhance the flow rate of fluids from, or into, the permeable formation. The fracture of the permeable formation is commonly achieved by injecting an incompressible fluid in a sufficient volume at a sufficient hydraulic pressure via the well into the permeable formation to cause the permeable formation to part, or fracture, under the transmitted stress.

In many instances, one or more upper permeable formations may be located above other lower permeable formations, with the permeable formations being separated by at least one impermeable formation. Commonly in such situations, the shallow or upper formation may be an aquifer and carry fresh water, useable as drinking water, and the deeper or lower formations may contain oil, gas, and/or brine, or may have the capacity to receive and hold waste materials. If one or more of the lower formations is fractured to inject wastes, the fracture must be controlled so that the fracture does not extend completely through the impermeable zone and permit hydrocarbons or waste materials to pass through from the lower formation to the upper formation. Such a fracture could result in a complete failure of the fracture treatment, contamination of the upper formation with the fracturing fluid and/or fluids from the lower formation, and, in the case of an oil or gas well, poor oil and/or gas production, the requirement of further remediation, or even abandonment of the producing zone. If waste material is to be injected into the lower zone, then a total fracture through the impermeable zone could pose serious and even illegal environmental hazards.

Conventionally, the upward growth of a fracture is monitored using temperature logs, tracer logs, or seismographs. Temperature logs and tracer logs, however, are generally unreliable and are used after-the-fact rather than in real time, thereby posing a potentially unacceptable hazard wherein hydrocarbons or waste products could leak into water that may be useable for human consumption. Seismographs are relatively expensive and require real-time data interpretation and display. There are thus many drawbacks associated with using conventional techniques for detecting the upward growth of a fracture.

Therefore, what is needed is a reliable, economical system and/or method for detecting, in real time, the upward growth of a hydraulic fracture.

SUMMARY OF THE INVENTION

The present invention, accordingly, provides a reliable, economical method and system for detecting in real time the growth of a hydraulic fracture through an impermeable subterranean zone separating a monitored upper zone and an injection lower zone, which zones are penetrated by a wellbore. In the method of the present invention, a pressure sensor is positioned in pressure sensing communication with the first subterranean zone, and the pressure sensor is monitored for a pressure increase in the first subterranean zone, the pressure increase being indicative of a hydraulic fracture extension from the second subterranean zone through the impermeable zone to the first subterranean zone.

In the system of the present invention, the wellbore includes casing and tubing positioned in the casing such that an annulus is defined between the casing and the tubing, and wherein at least one first perforation is defined in the casing for providing fluid communication between the injection zone and the interior of the wellbore, and at least one perforation is defined in the casing for providing fluid communication between the monitored zone and the annulus. A packer is positioned in the casing proximate to the impermeable zone between the casing and the tubing for preventing fluid communication through the wellbore between the monitored zone and the injection zone. A pump is connected to the tubing for pumping fluid into and through the tubing so that fluid may be injected into the injection zone. A pressure sensor is positioned for sensing a pressure in the annulus to monitor a pressure increase in the monitored zone as fluid is pumped into the injection zone, the pressure increase being indicative of a hydraulic fracture extension from the injection zone through the impermeable zone to the monitored zone.

DETAILED DESCRIPTION

Figure 1:
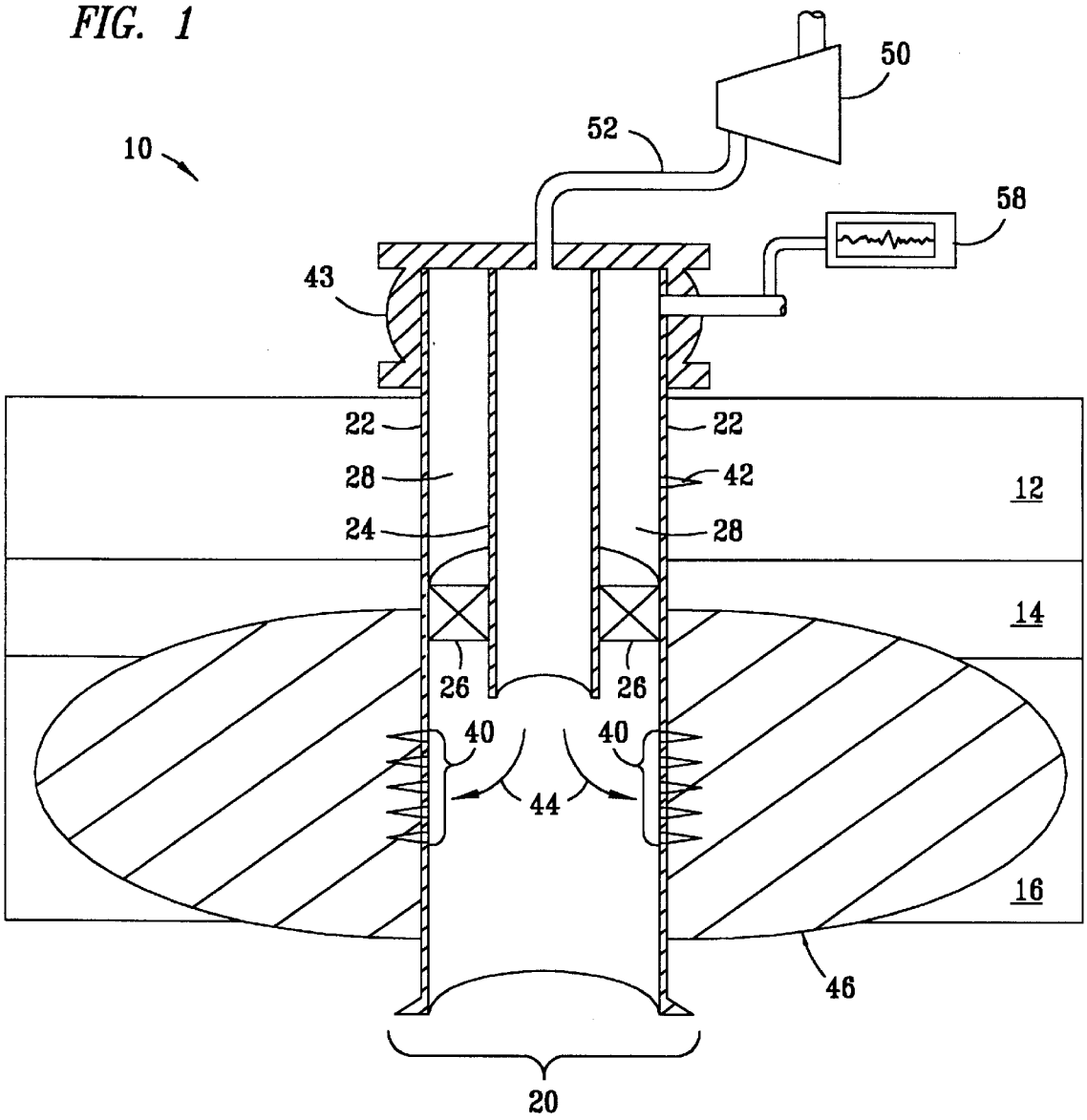
FIG. 1 is a schematic diagram of an embodiment of the present invention.

Referring to FIG. 1 of the drawings, the reference numeral 10 generally designates a subterranean geologic formation in which the system and method of the present invention may be implemented. The formation 10 includes an upper zone 12 which is to be monitored as described below, an intermediate zone 14, and a lower zone 16 which is to be fractured through the injection of a fluid as described below. Each of the upper and lower zones 12 and 16, respectively, comprise a relatively permeable material such as sand, sandstone, permeable rock, and the like, and the intermediate zone 14 comprises a substantially impermeable material such as impermeable rock and/or shale. It is understood that, while not shown in FIG. 1, the formation 10 would generally include an overburden having additional zones, or strata, extending from a ground surface to the top surface of the zone 12. If waste material is to be injected into the lower zone 16, then the overburden would preferably also include additional impermeable zones.

A wellbore 20 is formed in a manner well-known in the art from the ground surface through the geologic formation 10, including each of the zones 12, 14, and 16. The wellbore 20 includes a casing 22 which is cemented in place in the wellbore 20 and is sealingly positioned through the zones 12, 14, and 16 and the overlying zones. A pressure test is conducted to determine whether there is a cement leak between the casing 22 and the formation 10 and, if a cement leak is detected, conventional corrective measures are taken to seal the leak. A work string, i.e. tubing, 24 extends through the center of the casing, and a conventional packer 26 is positioned in the wellbore 20 proximate to the intermediate zone 14 between the casing 22 and the tubing 24 to prevent fluid communication between the upper and lower zones 12 and 16, respectively, via the annulus between the outside of the tubing 24 and the inside of the casing 22. The packer 26 also functions to center the tubing 24 in the casing 22, and thereby defines a casing annulus 28 between the tubing and the casing. Because the foregoing are well-known in the art, they will not be described in further detail herein.

In accordance with the present invention, the casing 22 is perforated with an explosive device (not shown) in a conventional manner in the lower zone 16, below the packer 26, so that a plurality of perforations 40 are formed therein for facilitating fluid communication between the lower zone 16 and the interior of the casing 22 below the packer 26 and the tubing 24. In a similar manner, the casing 22 is perforated with an explosive device (not shown) proximal to the upper zone 12, above the packer 26, so that at least one perforation 42 is formed to permit fluid pressure communication between the upper zone 12 and the casing annulus 28. A conventional wellhead 43 is positioned at the top of the wellbore 20 in a manner well known in the art.

Fracturing fluid injection equipment, as known to the art, such as a reciprocating pump 50, is located on the ground surface, and high pressure hoses and pipes, designated generally by the reference numeral 52, are connected between the pump 50 and the interior of the tubing 24 through the wellhead 43 for transporting fluid or slurry under high pressure from the pump 50 to the interior of the tubing 24. A conventional pressure sensor 58, such as a pressure gauge and/or a strip chart recorder, is connected in fluid communication with the annulus 28, and is configured for sensing and recording the pressure of gas in the annulus as a function of time.

In operation, a fracturing fluid (not shown) is prepared for injection into the lower zone 16, hereinafter referred to as the "injection" zone. The fracturing fluid may be any of a number of different generally incompressible liquids or fluids, such as a conventional fluid used in fracture processes, and may include hazardous waste products. Solid waste products that are included are crushed or pulverized as necessary to sand-sized particles and added to a liquid transport agent to create a slurry.

The prepared fracturing fluid is pumped by the high pressure pump 50 through the hoses and pipes 52 into the tubing 24 of the wellbore 20. The fluid passes down through the tubing 24, and then through the perforations 40 into the injection zone, along a path as indicated by arrows 44 and into a fracture indicated by shading 46. Injection of the fracturing fluid at pressures exceeding the minimum principle stress of the zone 16 of the formation 10 will create a hydraulic fracture in zone 16 which will grow and propagate as additional fluid is injected therein, thereby releasing hydrocarbons residing in the region of the fracture, or opening new cavities for the storage of waste products.

As fracturing fluid is injected into the injection zone 16, the pressure in the upper zone 12, referred to hereinafter as the "monitored" zone, is detected or monitored via the pressure sensor 58. An increase in the pressure detected and recorded by the pressure sensor 58 is indicative that a fracture has propagated through the intermediate zone 14, i.e., that "zone break-through" has occurred, and that fracturing fluid has invaded the monitored zone 12. If zone break-through is detected, the injection of fracturing fluid into the injection zone may be reduced or terminated as necessary to avoid further fracture upward growth. It can be appreciated that the indication of fracture growth by the pressure sensor 58 is in real time, thereby enabling immediate action to be taken in response to upward growth of a fracture.

Figure 2:
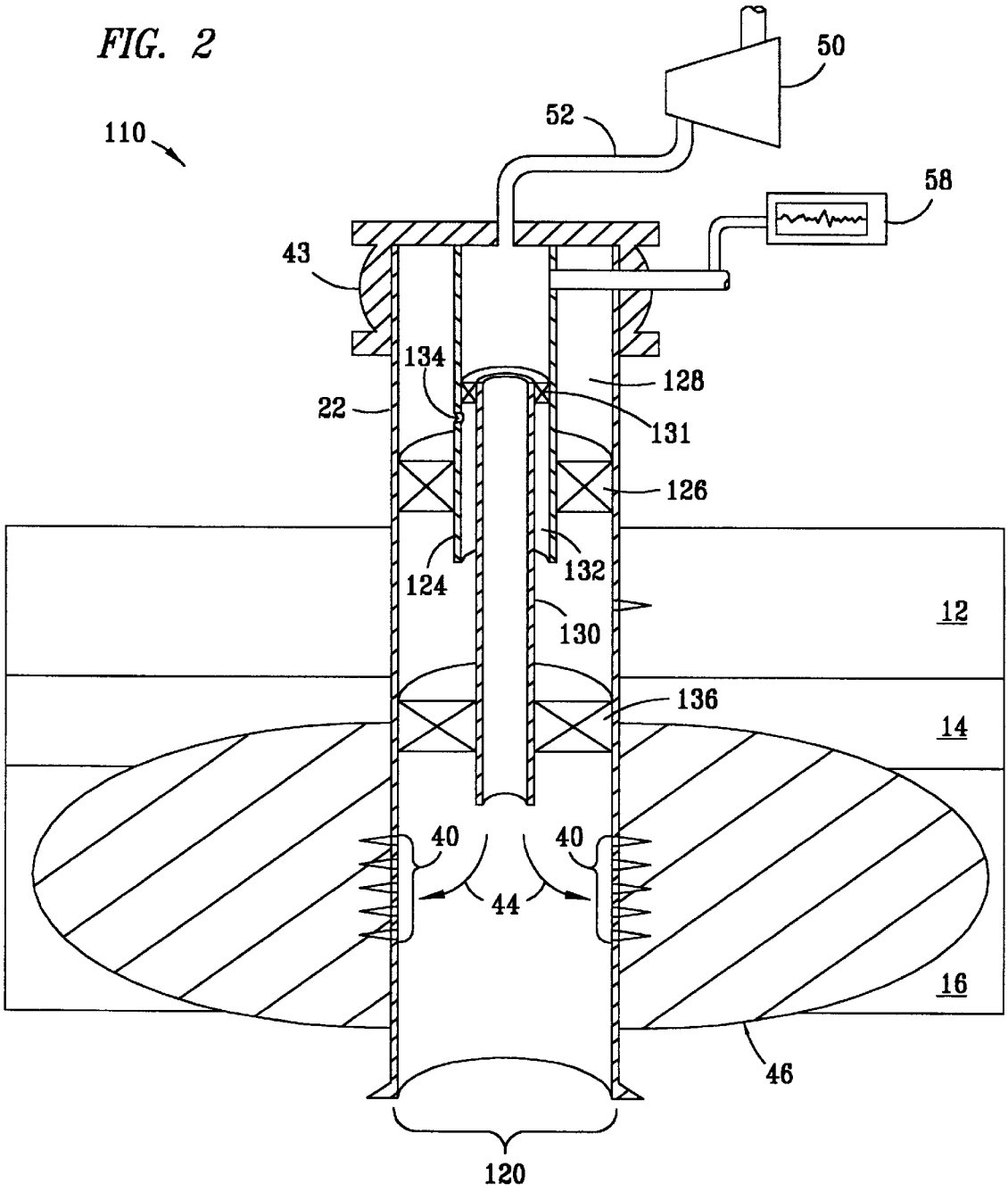
FIG. 2 is a schematic diagram of a further embodiment of the present invention.

FIG. 2 depicts a geologic formation 110 and wellbore 120 in which an alternate embodiment of the system and method of the present invention may be implemented. Since many elements of the formation 110 and wellbore 120 are identical to those of the previous system and method, these components will be referred to by the same reference numerals and will not be described in any further detail.

According to the embodiment of FIG. 2, tubing 124 extends through the center of the casing 22 and terminates in the upper zone 12. A tubing packer 126 is positioned in the wellbore 120 just above the upper zone 12 between the casing 22 and the tubing 124 for preventing fluid communication between the upper zone 12 and any zone (not shown) above the upper zone 12 via the interior of the casing. The tubing packer 126 also functions to center the tubing 124 in the casing 22, and thereby defines a casing annulus 128 between the tubing and the casing.

A scab liner 130 is hung in a nipple 131 from the tubing 124 above the tubing packer 126 in a conventional manner such that the nipple 131 provides a seal between the tubing and the liner 130 for preventing fluid communication between the interior of the tubing and a tubing annulus 132 formed between the tubing and the nipple. A gas lift mandrel or port 134 is placed in the wall of the tubing 124 above the tubing packer 126 for providing fluid communication between the casing annulus 128 and the tubing annulus 132. A liner packer 136 is positioned in the wellbore 120 proximate to the intermediate zone 14 between the casing 22 and the liner 130 for preventing fluid communication between the upper and lower zones 12 and 16, respectively, via the interior of the casing. Because the foregoing are well-known in the art, they will not be described in further detail herein.

In accordance with the alternate embodiment of the present invention, and in a manner similar to that described with respect to the previous embodiment, the casing 22 is perforated with an explosive device (not shown) in a conventional manner proximal to the lower zone 16, below the liner packer 136, so that a plurality of perforations 40 are formed therein for facilitating fluid communication between the lower zone 16, and the interior of the casing 22, liner 130, and tubing 124. In a similar manner, the casing 22 is further perforated with an explosive device (not shown) proximal to the upper zone 12, above the liner packer 136, so that at least one perforation 42 is formed therein for facilitating fluid pressure communication between the upper zone 12, the tubing annulus 132, and the casing annulus 128. The conventional wellhead 43 is positioned at the top of the wellbore 120.

As in the previous embodiment, high pressure generating equipment, such as the reciprocating pump 50, is located on the ground surface, and the high pressure hoses and pipes, designated generally by the reference numeral 52, are connected between the pump 50 and the interior of the tubing 124 through the wellhead 43 for transporting fluid or slurry under high pressure from the pump to the interior of the tubing 124. The conventional pressure sensor 58, such as a pressure gauge and/or a strip chart recorder, is connected in fluid communication with the annulus 128, and is configured for sensing and recording the pressure of gas in the annulus as a function of time.

In operation, a fracturing fluid (not shown) is prepared for injection into the lower zone 16, hereinafter referred to as the "injection" zone. The fracturing fluid may be any of a number of different generally incompressible liquids or fluids, such as a conventional fluid used in fracture processes, and may include hazardous waste products. Solid waste products that are included are crushed or pulverized as necessary to sand-sized particles and added to a liquid transport agent to create a slurry.

The prepared fracturing fluid is pumped by the high pressure pump 50 through the hoses and pipes 52 into the tubing 124 of the wellbore 120. The fluid passes down through the tubing 124, the liner 130, and then through the perforations 40 into the injection zone, along a path as indicated by arrows 44 and into a fracture indicated by shading 46. Injection of the fracturing fluid at pressures exceeding the minimum principle stress of the intermediate zone 14 of the formation 110 will create a hydraulic fracture in that zone which will grow and propagate as additional fluid is injected therein, thereby releasing hydrocarbons residing in the region of the fracture, or opening new cavities for the storage of waste products.

As fracturing fluid is injected into the injection zone 16, the pressure in the upper zone 12, referred to hereinafter as the "monitored" zone, is detected or monitored via the pressure sensor 58 through the gas lift mandrel or port 134. An increase in the pressure detected by the pressure sensor 58 is indicative that a fracture has propagated through the intermediate zone 14, i.e., that "zone break-through" has occurred, and that fracturing fluid has invaded the monitored zone 12. If zone break-through is detected, the injection of fluid into the injection zone may be reduced or terminated as necessary to avoid further fracture growth. It can be appreciated that the indication of fracture upward growth by the pressure sensor 58 is in real time, thereby enabling immediate action to be taken in response to upward growth of the fracture.

It is understood that the present invention can take many forms and embodiments. The embodiments described herein are intended to illustrate rather than to limit the invention. Accordingly, several variations may be made in the foregoing without departing from the spirit or the scope of the invention. For example, a gas lift valve may be disposed in the port 134. In another example, the pressure sensor 58 may be configured to generate, when a threshold pressure is reached, an alert indicating that upward growth of a fracture has been detected. The alert may be configured for automatically activating or deactivating another activity; the alert may, for example, be configured for automatically terminating the injection of fluid into the injection zone.

The present invention has several advantages. For example, the upward growth of a fracture can be detected more easily and simply with the present invention than is possible using conventional techniques. Additionally, the system and method described herein provides reliable real time detection of fracture upward growth more economically than is possible with conventional techniques. Still further, the present invention is more readily adaptable than conventional methods for providing long term, continuous monitoring of upward fracture growth in a zone above a waste injection zone.

Although illustrative embodiments of the invention have been shown and described, a wide range of modification, change, and substitution is contemplated in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. A method for detecting the growth of a hydraulic fracture through an impermeable subterranean zone separating a first subterranean zone and a second subterranean zone, the method comprising the steps of:

positioning a pressure sensor in pressure sensing communication with the first subterranean zone; and monitoring the pressure sensor for a pressure increase in the first subterranean zone during fracturing operations in the second subterranean zone, the pressure increase in the first subterranean zone being indicative of a hydraulic fracture extension from the second subterranean zone through the impermeable zone to the first subterranean zone.

2. The method of claim 1 wherein the first subterranean zone is in fluid communication with the annulus of a wellbore, and the step of positioning comprises positioning a pressure sensor in pressure sensing communication through the annulus with the first subterranean zone.

3. The method of claim 1 further comprising injecting fracturing fluid through the wellbore into the second subterranean zone.

4. A method for detecting the growth of a hydraulic fracture through an impermeable subterranean zone separating a monitored subterranean zone and an injection subterranean zone, which zones are penetrated by a wellbore having a casing and a tubing positioned in the casing such that an annulus is defined between the casing and the tubing, the method comprising the steps of:

a) perforating the casing in the injection zone so that the injection zone is in fluid communication with the interior of the casing;

b) perforating the casing in the monitored zone so that the monitored zone is in fluid communication with the annulus;

c) preventing fluid communication through the wellbore between the monitored zone and the injection zone;

d) pumping fluid through the tubing and injecting the fluid into the injection zone at fracturing conditions; and e) monitoring the monitored zone for a pressure increase in the monitored zone during the pumping and injecting, the pressure increase being indicative of a hydraulic fracture extending from the injection zone through the impermeable zone to the monitored zone.

5. The method of claim 4 further comprising the step of positioning a pressure sensor in pressure sensing communication with the monitored zone, and wherein the step of monitoring comprises monitoring the pressure sensor for the pressure increase in the monitored zone.

6. The method of claim 4 wherein the step of identifying includes the step of determining whether the pressure in the monitored zone exceeds a threshold pressure.

7. The method of claim 4 wherein the step of identifying includes the steps of recording the magnitude of the monitored pressure as a function of time, and determining when the recorded magnitudes increase.

8. The method of claim 4 wherein the step of preventing includes positioning a packer between the casing and the tubing, and between the monitored zone and the injection zone, such that the monitored zone is in fluid communication with the annulus and not in fluid communication with the injection zone, and wherein the step of monitoring comprises monitoring the pressure in the annulus.

9. The method of claim 4 wherein the wellbore further includes a liner extending downwardly from the tubing, and wherein the step of preventing includes positioning a first packer between the casing and the line, between the monitored zone and the injection zone, and positioning a second packer between the casing and the tubing above the monitored zone, and forming a port in the tubing above the second packer so that the monitored zone is in fluid communication with the annulus and not in fluid communication with the injection zone, and wherein the step of monitoring includes monitoring the pressure in the annulus.

10. A system for detecting the growth of a hydraulic fracture in an impermeable subterranean zone separating a monitored subterranean zone and an injection subterranean zone located below the monitored subterranean zone, the system comprising:

a wellbore penetrating the monitored zone, the impermeable zone, and the injection zone, wherein the wellbore includes casing and tubing positioned in the casing such that an annulus is defined between the casing and the tubing, and wherein at least one first perforation is defined in the casing for providing fluid communication between the injection zone and the interior of the wellbore, and at least one perforation is defined in the casing for providing fluid communication between the monitored zone and the annulus;

a packer positioned in the casing proximate to the impermeable zone between the casing and the tubing for preventing fluid communication through the wellbore between the monitored zone and the injection zone;

a pump connected to the tubing for pumping fluid into and through the tubing so that fluid may be injected into the injection zone; and a pressure sensor positioned for sensing a pressure in the annulus to monitor a pressure increase in the monitored zone as fluid is pumped into the injection zone, the pressure increase being indicative of a hydraulic fracture extension from the injection zone through the impermeable zone to the monitored zone.

11. The system of claim 10 wherein the pressure sensor includes a strip chart recorder for recording the magnitude of the pressure in the annulus as a function of time so that a determination may be made whether the pressure has increased thereby indicating that a hydraulic fracture is growing in the impermeable zone.

* * * * *